US005186443A

United States Patent [19]

Manley et al.

[11] Patent Number: 5,186,443

[45] Date of Patent: Feb. 16, 1993

[54] METHOD OF COLLATING NEWSPAPERS BASED UPON CREDIT CARD HOLDERS

[75] Inventors: John A. Manley, Vandalia; Aaron J. Belvo, Miamisburg; Todd C. Platt, Centerville; Andrew D. Bruce, Troy; Peter A. Wolf, Piqua, all of Ohio

[73] Assignee: AM International Incorporated, Chicago, Ill.

[21] Appl. No.: 662,355

[22] Filed: Feb. 28, 1991

[51] Int. Cl.[5] ..... B41F 13/54; B65H 5/30

[52] U.S. Cl. ..... 270/1.1; 270/55; 270/52

[58] Field of Search ..... 270/1.1, 52, 54, 55, 270/56, 57, 58

[56] References Cited

U.S. PATENT DOCUMENTS

| | | | |
|---|---|---|---|
| 4,121,818 | 10/1978 | Riley | 270/54 |
| 4,395,031 | 7/1983 | Gruber | 270/54 |
| 4,479,643 | 10/1984 | Seidel | 270/55 |
| 4,500,083 | 2/1985 | Wong | 270/54 |
| 4,800,505 | 1/1989 | Axelrod et al. | 270/58 X |
| 4,901,995 | 2/1990 | Kempisty | 270/55 |
| 4,948,109 | 8/1990 | Peterson | 270/55 |
| 4,989,852 | 2/1991 | Gunther, Jr. | 270/58 X |
| 5,013,019 | 5/1991 | Samuels | 270/1.1 |
| 5,039,075 | 8/1991 | Mayer | 270/58 X |

FOREIGN PATENT DOCUMENTS

| | | | |
|---|---|---|---|
| 623756 | 9/1978 | U.S.S.R. | 270/54 |

*Primary Examiner*—Edward K. Look
*Assistant Examiner*—John Ryznic
*Attorney, Agent, or Firm*—Tarolli, Sundheim & Covell

[57] ABSTRACT

Newspapers are collated with materials which vary as a function of the characteristics of the readers of the newspapers. For example, a newspaper for a reader having a credit card for a particular business establishment would include an insert which is an advertisement for the business establishment. A newspaper for a reader who did not have a credit card for the business establishment would not include the advertisement. Indicia identifying the reader for whom each newspaper is intended is printed on the jacket of the newspaper during the process of collating the newspaper. Further indicia may be applied onto inserts appropriate to the intended reader and/or advertiser.

4 Claims, 4 Drawing Sheets

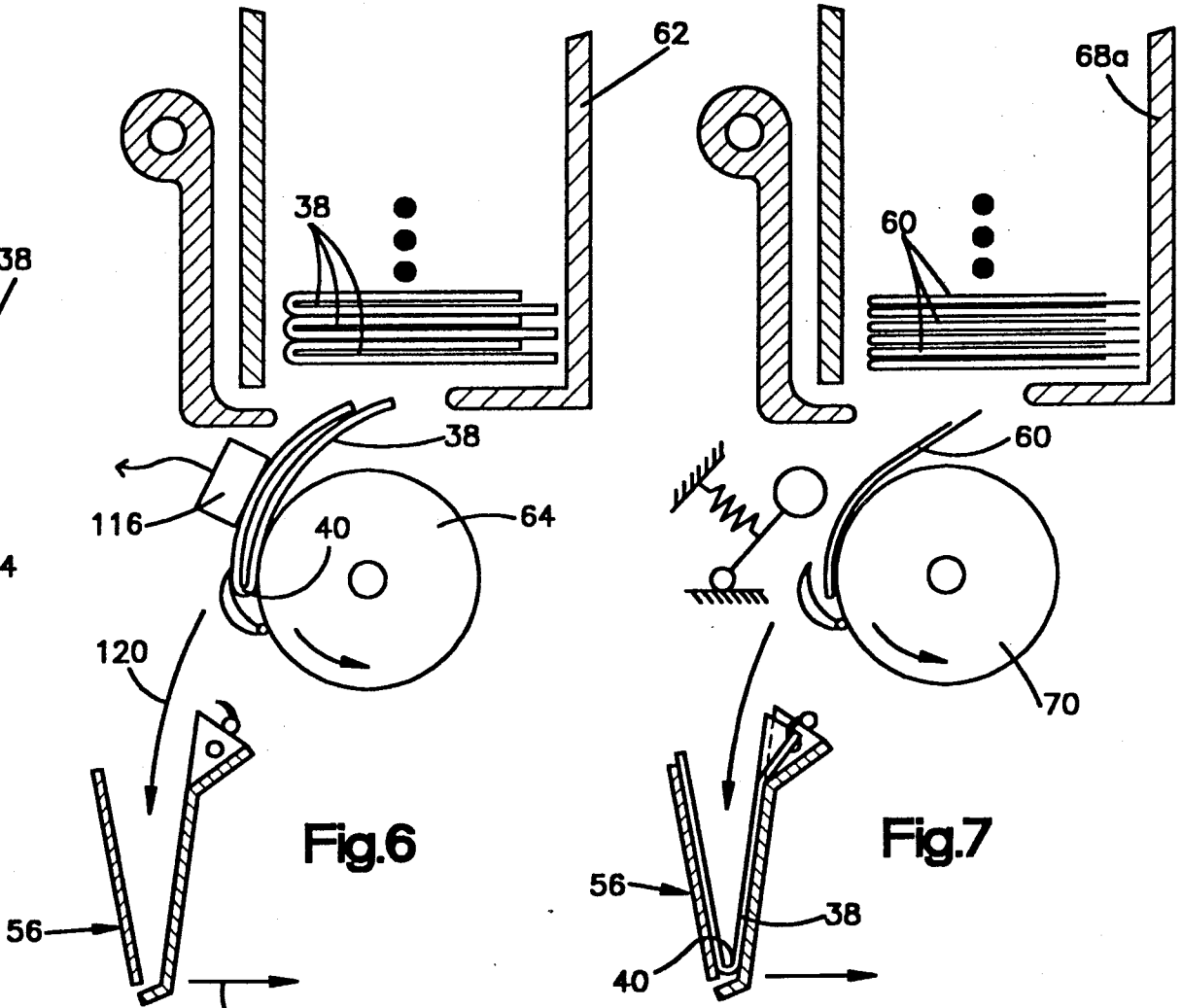
Fig.7
Fig.6
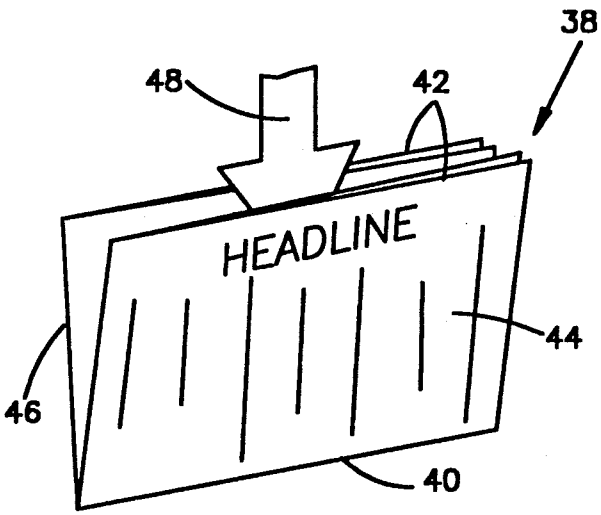
Fig.5

METHOD OF COLLATING NEWSPAPERS BASED UPON CREDIT CARD HOLDERS

BACKGROUND OF THE INVENTION

This invention relates to a new and improved method of collating newspapers.

A known apparatus for use in collating identical newspapers is disclosed in U.S. Pat. No. 4,721,296. The apparatus disclosed in this patent includes a collating conveyor assembly having a jacket feed station where jackets of newspapers are sequentially fed into upwardly opening pockets. Inserts are fed into each of the jackets in turn at a plurality of insert feed stations. Thus, as a pocket moves through each of the insert feed stations in turn, an insert is fed into the jacket at each of the feed stations. Therefore, the completed newspaper consists of a jacket and an insert from each of the insert feed stations.

All of the newspapers formed with the known apparatus disclosed in this patent contain the same inserts. Therefore, newspapers having the same content are delivered to readers having different characteristics. This results in articles, advertising material and other printed matter being disseminated to all readers even though these materials will be of substantial interest to only some of the readers.

SUMMARY OF THE INVENTION

The present invention provides a method of collating newspapers to contain materials which vary as a function of characteristics of the readers of the newspapers. The present invention also provides a method of collating newspapers with printed indicia identifying a reader. It is believed that it may be particularly advantageous to have reader identifying indicia printed on newspapers which contain materials which vary as a function of reader characteristics to assist in the distribution of the newspaper.

In order to collate newspapers containing materials which vary as a function of characteristics of the readers of the newspapers, an insert for a reader having a particular characteristic is fed into a newspaper jacket at an insert feed station. When the jacket of a newspaper for a reader who does not have the particular characteristic goes through the insert feed station, an insert is not fed into the jacket. Therefore, the two newspapers contain different materials with one of the newspapers being intended for a reader having a particular characteristic and the other newspaper being intended for a reader who does not have the particular characteristic.

During collating of a newspaper, indicia identifying an intended reader for the newspaper is printed on the jacket of the newspaper. By printing indicia identifying the reader on the jacket of a newspaper, delivery of the newspaper, by mail or other means, is facilitated. While the printing of the reader identifying indicia on the jackets of newspapers containing materials which vary as a function of characteristics of the readers is particularly advantageous, the printing of reader identifying indicia on the jackets of identical newspapers could be performed during collating of the newspapers.

BRIEF DESCRIPTION OF THE DRAWINGS

The foregoing and other features of the invention will become more apparent upon a consideration of the following description taken in connection with the accompanying drawings, wherein:

FIG. 5 is a schematic illustration of the manner in which a newspaper is collated using the apparatus of FIGS. 1–4;

FIG. 6 is a schematic illustration depicting the manner in which indicia is printed on a jacket of a newspaper as the jacket is fed from a hopper to a pocket during operation of the inserter of FIGS. 3 and 4;

FIG. 7 is a schematic illustration, generally similar to FIG. 6, illustrating the manner in which an insert is fed into the open jacket of the newspaper as the pocket moves through an insert feed station;

DESCRIPTION OF ONE SPECIFIC PREFERRED EMBODIMENT OF THE INVENTION

General Description

Figure 1:
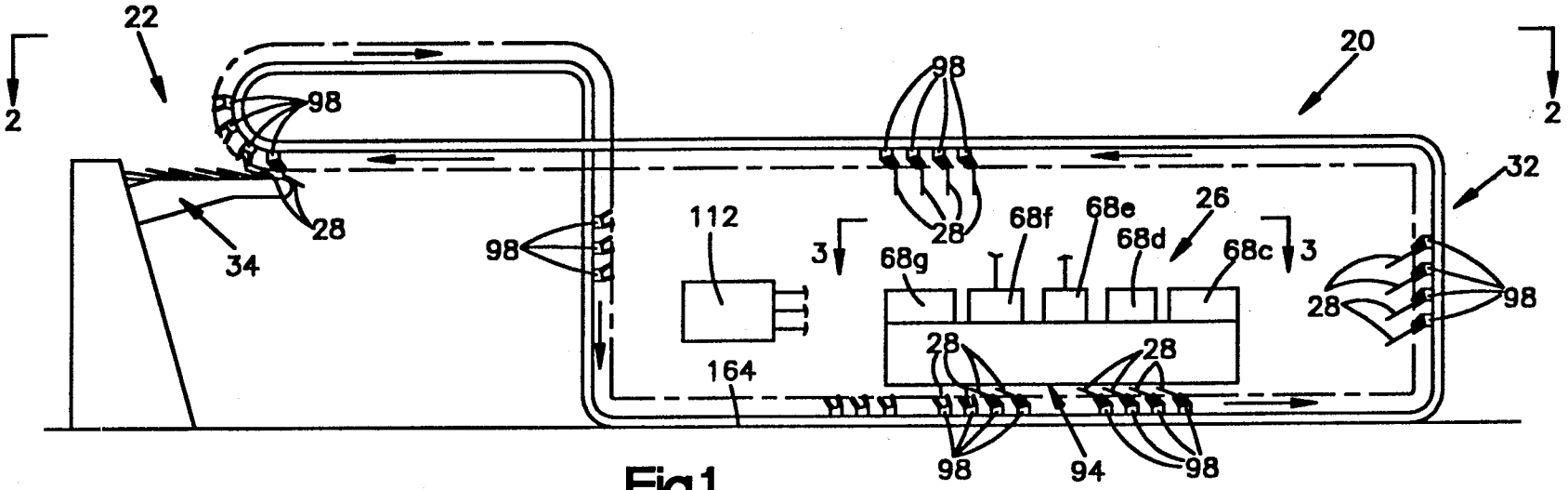
FIG. 1 is a schematic elevational view of a newspaper collating apparatus which is operated in accordance with the method of the present invention.
Figure 2:
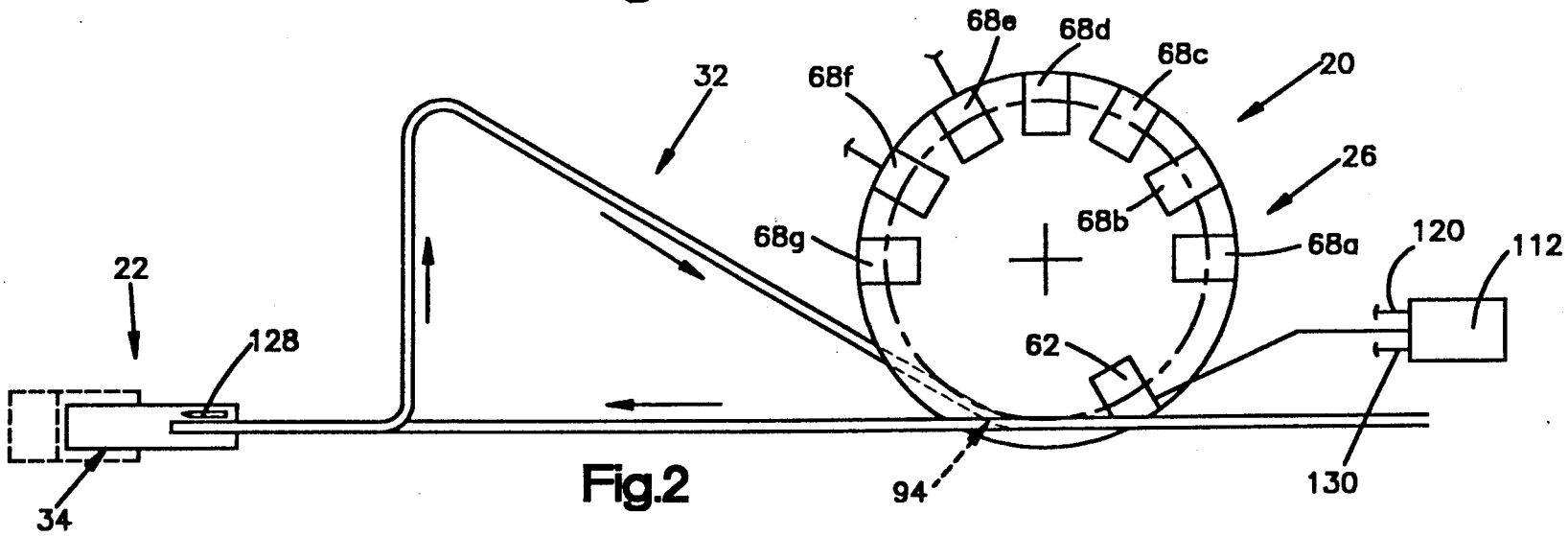
FIG. 2 is a schematic plan view, taken generally along the line 2—2 of FIG. 1, further illustrating the construction of the newspaper collating apparatus.
Figure 3:
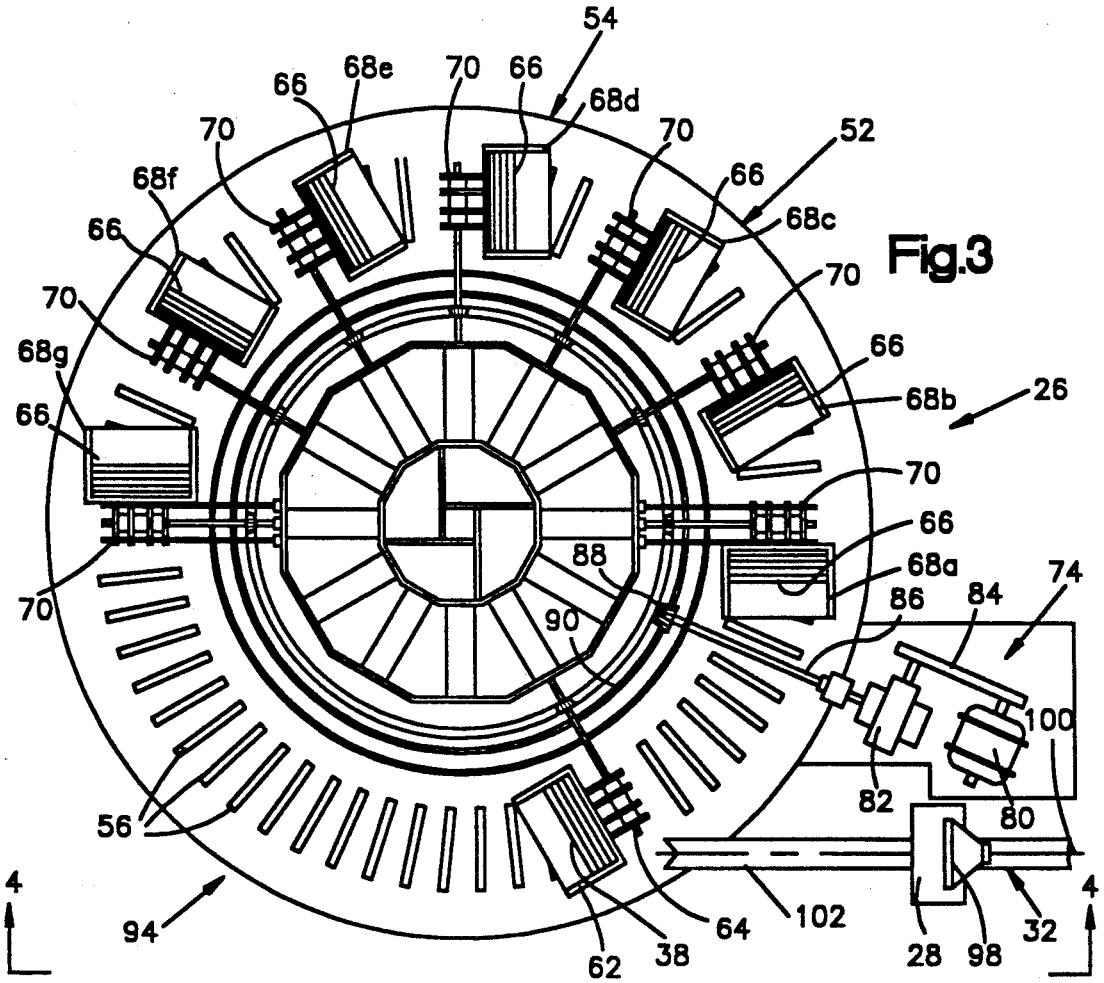
FIG. 3 is a schematic plan view, taken generally along the line 3—3 of FIG. 1, illustrating the construction of one specific inserter utilized to collate newspapers in accordance with the method of the present invention.
Figure 4:
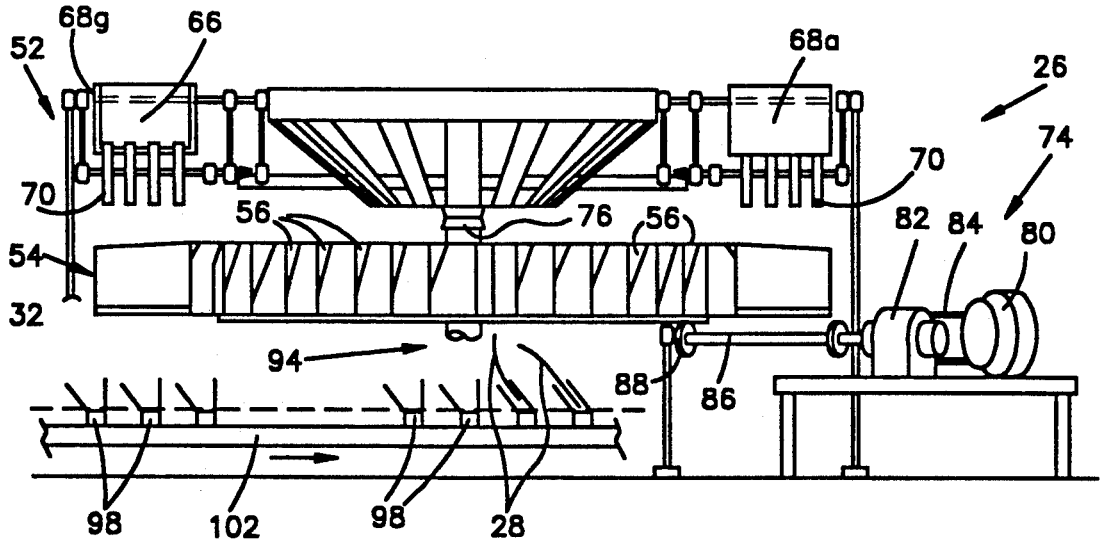
FIG. 4 is an elevational view, taken generally along the line 4—4 of FIG. 3, further illustrating the construction of the inserter.

A sheet material handling apparatus 20 (FIGS. 1 and 2) is operated in accordance with the present invention to form newspapers. The apparatus 20 transports the newspapers to a receiving station 22. The sheet material handling apparatus 20 includes a collating conveyor assembly 26 (FIGS. 3 and 4) which is operable to form newspapers 28 (FIGS. 1 and 4). A gripper or delivery conveyor assembly 32 sequentially grips newspapers 28 formed by the collating conveyor assembly 26 and transports them to the receiving station 22 (FIGS. 1 and 2). A receiving conveyor 34 transports the newspapers 28 to a location for further processing.

Each of the newspapers 28 has a jacket or folded outer cover section 38 (FIG. 5) into which inserts or inner sections are stuffed during operation of the collator conveyor assembly 26. The jacket 38 has a folded or closed edge portion 46 and cut or open edge portions 42. A headline side or section 44 of the jacket 38 extends between a central fold edge portion 40 and one of the cut or open edge portions 42. Similarly, a back side or section 46 extends between the central fold 40 and the other cut or open edge portion 42.

During operation of the collator conveyor assembly 26, the inserts for the newspapers 28 are fed into the opened jacket 38 in the manner indicated schematically by the arrow 48 in FIG. 5, to form a complete newspaper. It should be understood that the newspapers 28 could be formed in an orientation other than the upright orientation of FIG. 5.

Collator Assembly

The collator assembly 26 is a known newspaper stuffing or assembling machine. The collator conveyor assembly 26 (FIGS. 3 and 4) includes a stationary sheet material infeed mechanism 52 which is disposed directly above a movable rotor or collating conveyor 54 having a plurality of collating spaces 56. In the case of the illustrated newspaper stuffing machine, the collating spaces 56 are bottom opening pockets.

The sheet material infeed mechanism 52 includes a jacket feed station at which a jacket hopper 62 (FIG. 3) is located. A plurality of the jackets 38 are held in the hopper 62. If desired, newspaper jackets 38 could be conveyed directly to the hopper 62 from a printing press, in the manner described in U.S. Pat. Nos. 3,881,716 and 4,034,974.

The jackets 38 are sequentially fed from the stationary hopper 62 into the pockets 56 of the circular rotor 54 by a sheet feed mechanism 64. The sheet feed mechanism 64 feeds the jackets 36 into the pockets 56 with the headline sides or sections 44 of the jackets facing in the direction of movement of the pockets 56. As the rotor 54 moves the circular array of pockets 56 in a counterclockwise direction (as viewed in FIG. 3), inserts 66 are fed from hoppers 68*a* through 68*g* by sheet feed mechanisms 70. Of course, the number of insert feed stations from which inserts are fed will vary depending upon the size of a particular newspaper.

A drive mechanism 74 rotates the rotor 54 at a constant speed about a center post 76 (FIG. 4) so that the open upper ends of the pockets 56 sequentially move along a continuous closed loop formed by the stationary circular array of hoppers 62 and 68 at the jacket and insert feed stations. The drive assembly 74 includes a motor 80 which is connected with a speed reducer 82 by a belt 84 (FIGS. 3 and 4). During operation of the motor 80, a drive shaft 86 rotates a pinion gear 88, disposed in meshing engagement with a ring gear 90 fixedly connected with the rotor 54. Rotation of the pinion gear 88 rotates the rotor 54 in a counterclockwise direction as viewed in FIG. 3.

As each of the pockets 56 goes through a delivery station 94, a cam control mechanism effects movement between opposite sides of the pocket to open the lower end of the pocket. As a pocket 56 opens, a newspaper 28 is delivered by being dropped from the pocket downwardly to the gripper conveyor assembly 32 (FIGS. 7–10). The manner in which the collator conveyor assembly 26 is constructed is generally the same as is disclosed in U.S. Pat. No. 2,461,573. However, it is contemplated that the collator conveyor assembly 26 could be an NP630 or NP2299 Newspaper Inserter which is commercially available from AM Graphics of Dayton, Ohio.

Although a specific collator conveyor assembly 26 having a circular construction has been disclosed, the collator conveyor assembly could have a different construction. For example, the collator conveyor assembly could have a linear construction similar to the constructions shown in U.S. Pat. Nos. 4,236,706 and 4,499,834 and 4,641,825. Although the newspapers 28 are preferably delivered by being dropped to the gripper conveyor assembly 32 from the collator assembly 26, the newspapers could be delivered in other ways if desired. For example, the newspapers could be delivered by being removed from the open upper end portions of the pockets 56.

Gripper Conveyor Assembly

The gripper conveyor assembly 32 includes a plurality of identical grippers 98 which are interconnected by a conveyor chain. The conveyor chain is movable at a constant speed along a track which has been shown schematically in FIGS. 1–4. The track extends in a continuous loop from the discharge station 94 to the receiving station 22 and back to the discharge station.

The grippers 98 are sequentially closed to engage the newspapers 28 at the discharge station 94 (FIG. 4) while the newspapers are being transported by the rotor 54 of the collator 26. The grippers 98 are then moved along the track from the discharge station 94 to the receiving station 22 (FIG. 1). At the receiving station 22, the grippers 98 are opened and the newspapers are dropped from the grippers.

Although the grippers 98 could have many different constructions, such as the construction shown in U.S. Pat. No. 4,381,056, a preferred embodiment of the gripper 98 has the same construction as disclosed in U.S. Pat. No. 4,681,213. The collator conveyor assembly 26 has the same general construction as disclosed in U.S. Pat. No. 4,721,296. The collator conveyor assembly 26 cooperates with the gripper conveyor assembly 32 in the same manner as is described in the aforementioned U.S. Pat. No. 4,721,296.

Collating Newspapers Containing Different Materials

In accordance with one of the features of the present invention, the collator conveyor assembly 26 is operated to collate newspapers 28 containing materials which vary as a function of characteristics of the readers of the newspapers. Newspapers intended for a reader having one characteristic will contain an insert which is not included in a newspaper intended for another reader which does not have that characteristic. Thus, the newspapers are, to some extent at least, customized to contain materials which vary as a function of geographic and/or demographic characteristics of the readers of the newspapers.

For example, a newspaper intended for a reader having a credit card for a particular business establishment may contain an insert which is an advertisement for that business establishment. The newspaper intended for a reader which does not have a credit card for the particular business establishment would not contain the insert which is an advertisement for that business establishment. Of course, the content of the newspaper could be varied as a function of reader characteristics other than the possession of credit cards. For example, the materials in a particular newspaper could be varied as a function of the geographic area in which the intended reader lives, or the sports enjoyed by the reader's family, etc.

The operation of the collator conveyor assembly 26 is regulated by a controller 112 (FIG. 1). In addition to the usual control functions associated with operation of the collator conveyor assembly 26, the controller 112 can either inhibit or enable the feeding of inserts from the hoppers 68*e* and 68*f* depending upon the characteristics of a reader for whom a newspaper is intended.

Thus, a memory in the controller 112 contains data identifying particular characteristics of readers or subscribers for whom a newspaper is intended. The controller 112 then either enables or inhibits the feeding of an insert from the hoppers 68*e* and/or 68*f* as a jacket section for a reader moves through the feed stations at which these hoppers are located.

In accordance with another feature of the present invention, the controller 112 enables an ink jet printer 116 (FIG. 6) to print indicia identifying an intended reader on each newspaper jacket 38 in turn. The memory in the controller 112 contains data, i.e., address information, identifying specific newspaper readers or subscribers. Thus, the data contained in the controller 112 includes the name and addresses of readers of the newspapers assembled by collator assembly 26. The data contained in the controller 112 could also include special messages appropriate to these subscribers, such as subscription lapsing or special sales promotions to be printed on the jacket 38 or inserted into the text.

The controller 112 could have any one of many known constructions. It is contemplated that it may be preferred to construct the controller with a Motorola 68020 microcomputer to control the operation of the printer 116 and a Motorola 68030 microcomputer to control the operation of the collator conveyor assembly 26. These microcomputers are commercially available from Motorola Communications & Electronics, Inc. of Tempe, Ariz. The ink jet printer 116 may also have many different constructions. However, it may be preferred to use a Cheshire/Videojet Model 9416 ink jet printer. This printer is commercially available from Cheshire/Videojet of Mundelein, Ill.

Each jacket 38 is fed by the sheet feed mechanism 64 with the central fold 40 downward. As a jacket 38 is fed by the sheet feed mechanism 64, the controller 112 (FIGS. 2 and 3) activates the ink jet printer 116 (FIG. 6) to print the name and address of the intended reader on the outside of the jacket. Of course, other indicia could be printed on the jacket 38 if desired.

Although the ink jet printer 116 has been shown in FIG. 6 as printing on the jacket 38 as it is fed to the pocket 56, the ink jet printer could be at other locations. Thus, it may be preferred to have the jet printer 116 print on the jacket 38 before the jacket is loaded into the hopper 62. In addition, the ink jet printer 116 could be located downstream of the collator conveyor assembly 26 if desired.

Once the jacket 38 has been fed into the pocket 56, the jacket is opened in the manner described in U.S. Pat. No. 4,477,067. Of course, other known methods of opening the jacket could be utilized if desired. Although the jackets 38 are identical, different jackets could be provided for different readers if desired.

After the jacket 38 has been opened in the pocket 56, the pocket moves beneath the hopper 68*a* at the first insert feed station. An insert 60 is fed from the hopper 68*a* into the open jacket section 38 in the manner illustrated schematically in FIG. 7. Additional inserts 60 are fed into the open jacket 38 as the pocket 56 sequentially moves through the insert feed stations at which the hoppers 68*b*, 68*c* and 68*d* are located.

The characteristics of the intended reader for the newspaper in the pocket 56 are such that the controller 112 (FIG. 2) does not transmit a signal over a lead 120 to an inhibit mechanism 124. This causes the inhibit mechanism 124 to remain blocking the feeding of an insert 60 from the hopper 68*e*, in the manner shown schematically in FIG. 8. This is done because the characteristics of the reader for whom the newspaper in the pocket 56 is intended are such that the newspaper is not to contain an insert 60 from the hopper 68*e*. For example, the inserts 60 in the hopper 68*e* could contain advertisements for a business establishment and the intended reader for the newspaper in the pocket 56 does not have a credit card for that business establishment.

As the rotor 54 continues to rotate, the pocket 56 moves beneath the hopper 68*f* (FIG. 9) at the next adjacent insert feed station. In this case, the reader for whom the newspaper in the pocket 56 is intended has a characteristic such that he is to receive an insert from the hopper 68*f*. For example, the inserts 60 in the hopper 68*f* could contain advertisements for a second business establishment and the intended reader for the newspaper in the pocket 56 has a credit card for the second business establishment.

Therefore, the controller 112 (FIG. 2) transmits an enable signal over a lead 130 (FIG. 9) to an inhibit mechanism 134. This causes the inhibit mechanism 134 to retract and allow an insert 60 to be fed from the hopper 68*f* by the feed mechanism 70. The feed mechanism 70 feeds the insert into the open jacket 38 in the pocket 56.

The inhibit mechanism 134 is biased toward the enable or retracted condition. Therefore, the absence of an electrical potential on the lead 130 functions as an enable signal. Of course, the inhibit mechanism 134 could be biased to the extended condition if desired.

After an insert has been fed into the pocket 56 from the hopper 68*g* (FIG. 2) at the last insert feed station, the pocket 56 moves to the delivery station 94. At the delivery station 94, the pocket 56 is opened, in the manner indicated schematically in FIG. 10. A completed newspaper then falls downwardly to the open lower end of the pocket and is engaged by a gripper 98 (FIG. 1) in the gripper conveyor assembly 32. The gripper conveyor assembly 32 then transports a completed newspaper to the receiving conveyor 34 (FIG. 1).

Since the name and address of the reader for whom the newspaper 28 is intended has been printed on the jacket 38, the newspaper can be mailed or otherwise delivered to the intended reader. The newspaper will not contain an insert 60 from the hopper 68*e*. However, the characteristics of this reader are such that he should receive an insert from the hopper 68*f*. Therefore, the newspaper contains an insert 60 from the hopper 68*f*.

As the next succeeding pocket 56 proceeds to the jacket feed station beneath the hopper 62 (FIG. 6), the next jacket 38 in the hopper 62 is fed into this pocket. As this occurs, the ink jet printer 116 prints the name and address of a second reader on the jacket 38. As the pocket 56 moves beneath the hoppers 68*a*, 68*b*, 68*c* and 68*d*, inserts are fed into the jacket 38. However, since the second reader's characteristics are different than the first reader's characteristics, the controller 112 transmits an enable signal over the lead 120 to cause the inhibit assembly 124 to retract. Therefore, an insert 60 is fed from the hopper 68*e* for the second reader.

Figures 8, 9, 10:
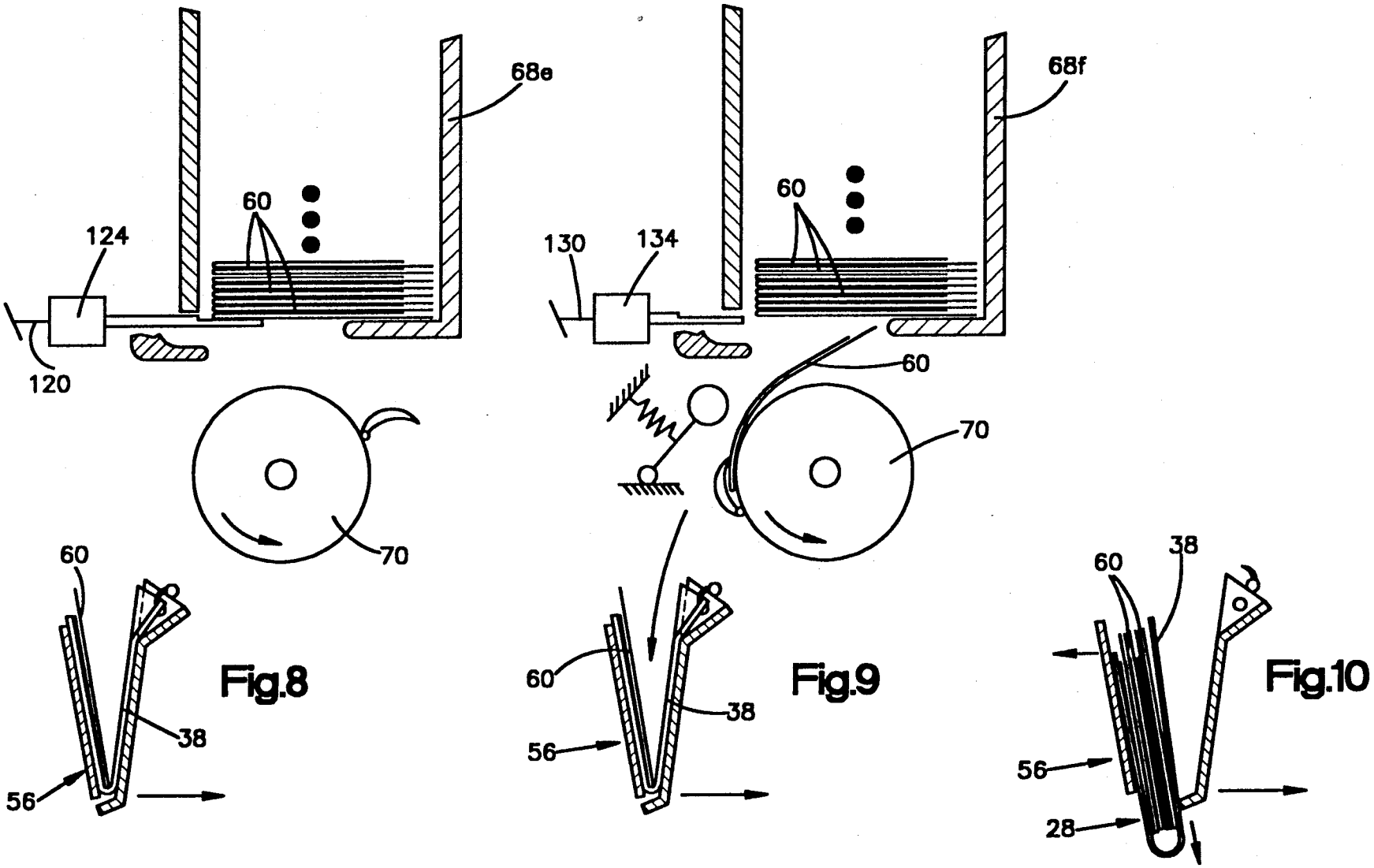
FIG. 8 is a schematic illustration, generally similar to FIG. 7, illustrating the manner in which the feeding of an insert at an insert feed station in the apparatus of FIGS. 1–4 is inhibited.
FIG. 9 is a schematic illustration depicting the enabling of the feeding of an insert to the jacket of FIG. 8 after the jacket has moved to another insert feed station.
FIG. 10 is a schematic illustration depicting the manner in which the pocket is opened to deliver the completed newspaper having a jacket containing inserts fed from the feed stations of FIGS. 7 and 9 and without an insert from the feed station of FIG. 8.

As the pocket 56 containing the newspaper for the second reader moves beneath the hopper 68*f*, the controller 112 may retract the inhibit mechanism 134 as shown in FIG. 9, or, depending upon the second reader's characteristics, extend the inhibit mechanism. Assuming that the second reader's characteristics are such that he is not to receive an insert 60 from the hopper 68*f*, the inhibit mechanism 134 is extended to block the feeding of an insert from the hopper 68*f* into the jacket 38 of the newspaper intended for the second reader.

Although the name and address of a reader is printed on a jacket 38 as it is fed from the hopper 62 (FIG. 6) with the ink jet printer 116, the name and address of the reader could be printed on the jacket at other locations in the collator conveyor assembly 26. Thus, ink jet printers could be provided on each of the pockets 56 if desired. It is also contemplated that ink jet printers could be provided to print on the inserts 60 in much the same manner in which the ink jet printer 116 prints on the jackets 38. Of course, the indicia printed on the inserts could be different than the indicia printed on the jackets 38. The indicia printed on the jacket 38 could be a machine readable bar code if desired.

The printing of indicia identifying a reader on a jacket 38 of a newspaper 28 is particularly advantageous when the newspaper contains materials which are a function of one or more characteristics of a reader for whom the newspaper is intended. However, identifying indicia could be printed on the jackets 38 of identical newspapers. In addition, it should be understood that although it is preferred to print reader identifying indicia on the jackets of newspapers containing materials which vary as a function of characteristics of the readers of the newspapers, identifying indicia could be omitted or could be printed at another location in the newspaper.

Conclusion

The present invention provides a method of collating newspapers 28 to contain materials which vary as a function of characteristics of the readers of the newspapers. The present invention provides a method of collating newspapers 28 with printed indicia identifying a reader. It is believed that it will be particularly advantageous to have indicia printed on newspapers which contain materials which vary as a function of reader characteristics.

In order to collate newspapers 28 containing materials which vary as a function of characteristics of the readers of the newspapers, an insert 60 for a reader having a particular characteristic is fed into the newspaper jacket 38 at insert feed station 68*e* or 68*f*. When the jacket 38 of a newspaper for a reader who does not have a particular characteristic goes through the insert feed station 68*e* or 68*f*, an insert 60 is not fed into the jacket. Therefore, the two newspapers 28 contain different materials with one of the newspapers being intended for a reader having a particular characteristic and the other newspaper being intended for a reader who does not have the particular characteristic.

During collating of a newspaper, indicia identifying an intended reader for the newspaper is printed on the jacket 38 of the newspaper. By printing indicia identifying the reader on the jacket 38 of a newspaper, delivery of the newspaper, by mail or other means, is facilitated. While the printing of the reader identifying indicia on the jackets 38 of newspapers 28 containing materials which vary as a function of characteristics of the readers is particularly advantageous, the printing of reader identifying indicia on the jackets of identical newspapers could be performed during collating of the newspapers.

Having described specific preferred embodiments of the invention, the following is claimed:

1. A method of collecting newspapers containing materials which vary as a function of characteristics of the readers of the newspapers, said method comprising the steps of providing newspaper jackets for a first newspaper reader having a credit card for a newspaper advertiser and for a second newspaper reader who does not have a credit card for the newspaper advertiser, each of the jackets having a closed edge portion and an open edge portion and a central fold which extends between the open and closed edge portions and divides the jacket into first and second sections, moving each of the jackets in turn through a series of newspaper insert feed stations with the central folds in the jackets downward and the first and second sections spread apart to enable newspaper inserts to be fed into the jackets, feeding inserts for a newspaper for the first reader having a credit card for the newspaper advertiser into a first jacket at a first plurality of the insert feed stations as the first jacket moves through the series of insert feed stations, and feeding inserts for a newspaper for the second reader who does not have a credit card for the newspaper advertiser into a second jacket at a second plurality of insert feed stations as the second jacket moves through the series of insert feed stations, said step of feeding inserts into the second jacket including feeding newspaper inserts into the second jacket at some feed stations where newspaper inserts were fed into the first jacket and moving the second jacket through at least one feed station where a newspaper insert containing an advertisement for the newspaper advertiser was fed into the first jacket for the first reader having a credit card for the newspaper advertiser without feeding an insert into the second jacket for the second reader who does not have a credit card for the newspaper advertiser.

2. A method as set forth in claim 1 further including the step of printing indicia on the first jacket of the plurality of jackets identifying the first reader having a credit card for the newspaper advertiser prior to performance of said step of feeding inserts into the first jacket and printing indicia on the second jacket of the plurality of jackets identifying the second reader who does not have a credit card for the newspaper advertiser prior to performance of said step of feeding inserts into the second jacket.

3. A method as set forth in claim 2, further including the step of providing a plurality of upwardly opening pockets, feeding each of the jackets in turn into an upwardly opening pocket with the central fold downward, said step of moving each of the jackets in turn through a series of newspaper insert feed stations including moving each of the upwardly opening pockets in turn through the insert feed stations, said step of feeding inserts for a newspaper for the first reader having a credit card for the newspaper advertiser into the first jacket including feeding inserts downwardly into the first jacket while the first jacket is moving through the insert feed stations in a first one of the pockets, said step of feeding inserts for a newspaper for the second reader who does not have a credit card for the newspaper advertiser into the second jacket including feeding inserts downwardly into the second jacket while the second jacket is moving through the insert feed stations in a second one of the pockets.

4. A method as set forth in claim 3 further including the steps of moving a newspaper for the first reader having a credit card for the newspaper advertiser out of the first pocket by opening a lower end portion of the first pocket and moving the newspaper for the first reader out of the open lower end portion of the first pocket, and moving a newspaper for the second reader who does not have a credit card for the newspaper advertiser out of the second pocket by opening a lower end portion of the second pocket and moving the newspaper for the second reader out of the open lower end portion of the second pocket.

* * * * *